US005304042A

United States Patent [19]

Kayukawa et al.

[11] Patent Number: 5,304,042

[45] Date of Patent: Apr. 19, 1994

[54] VARIABLE DISPLACEMENT COMPRESSOR

[75] Inventors: Hiroaki Kayukawa; Kazuya Kimura; Shigeyuki Hidaka; Toru Takeichi; Kenji Takenaka, all of Kariya, Japan

[73] Assignee: Kabushiki Kaisha Toyoda Jidoshokki Seisakusho, Kariya, Japan

[21] Appl. No.: 43,282

[22] Filed: Apr. 6, 1993

Related U.S. Application Data

[63] Continuation-in-part of Ser. No. 939,116, Sep. 2, 1992.

[30] Foreign Application Priority Data

Apr. 10, 1992 [JP] Japan ..... 4-91106

[51] Int. Cl.[5] ..... F04B 1/12

[52] U.S. Cl. ..... 917/222.1; 917/769; 74/60; 91/499

[58] Field of Search ..... 417/222.1, 222.2, 269, 417/270; 91/499, 504, 505; 74/60

[56] References Cited

U.S. PATENT DOCUMENTS

| | | | |
|---|---|---|---|
| 4,073,603 | 2/1978 | Abendschein et al. | 417/270 |
| 4,178,135 | 12/1979 | Roberts | 417/222.2 |
| 4,221,595 | 9/1980 | Terauchi | 74/60 |
| 4,553,905 | 11/1985 | Swain et al. | 417/222.2 |
| 4,581,980 | 4/1986 | Berthold | 92/12.2 |
| 4,674,957 | 6/1987 | Ohta et al. | 417/222.2 |
| 4,732,545 | 3/1988 | Ohta | 417/222.2 |
| 4,815,358 | 3/1989 | Smith | 417/222.2 |
| 4,884,952 | 12/1989 | Kanamaru et al. | 417/222.2 |
| 5,055,004 | 10/1991 | Ebbing et al. | 417/222.2 |
| 5,095,807 | 3/1992 | Wagenseil | 92/12.2 |
| 5,105,728 | 4/1992 | Hayase et al. | 417/222.2 |
| 5,174,728 | 12/1992 | Kimura et al. | 417/222.2 |
| 5,181,453 | 1/1993 | Kayukawa et al. | 92/12.2 |
| 5,184,536 | 2/1993 | Arai | 92/12.2 |

*Primary Examiner*—Richard A. Bertsch
*Assistant Examiner*—Peter Korytnyk
*Attorney, Agent, or Firm*—Brooks Haidt Haffner & Delahunty

[57] ABSTRACT

A plurality of pistons of a variable displacement compressor are reciprocatably disposed in cylinder bores which are formed in a housing. A drive shaft is rotatably supported in the housing. A lug plate is rotatable with the drive shaft. A swash plate is tiltably and slidably mounted on the drive shaft. The swash plate is operatively coupled with the pistons. A hinge mechanism connects the lug plate and the swash plate. The hinge mechanism causes the pistons to reciprocate via the lug plate and the swash plate, in response to the rotational motion of the drive shaft. The hinge mechanism includes a pin, which has a first and a second end portions. The first end portion of the pin is slidably inserted into the swash plate. A support arm protrudes from the lug plate, and further includes a bush. The bush rotatably supports the second end portion of the pin.

19 Claims, 8 Drawing Sheets

VARIABLE DISPLACEMENT COMPRESSOR

CROSS REFERENCE TO RELATED APPLICATIONS

This is a continuation-in-part application of the U.S. application Ser. No. 07/939,116 filed on Sep. 2, 1992, now issued, entitled VARIABLE DISPLACEMENT COMPRESSOR, which is incorporated by reference.

BACKGROUND OF THE INVENTION

1. Field of the Invention

The present invention relates to an improved variable displacement swash plate type compressor suitable for use in a vehicle air conditioning system.

2. Description of the Related Art

FIG. 11 shows a conventional swash plate type of variable displacement compressor (hereinafter, simply referred to as a compressor). In this type of compressor, a rotary journal 103, which can tilt in the forward or backward direction along a drive shaft 100, is coupled, via a link pin 102, with a lug plate 101 mounted on the drive shaft 100. A swash plate 104 is coupled with the rotary journal 103. A plurality of cylinder bores 105 are provided in a cylinder block 110. Each one of the bores 105 accommodates a piston 106 that is connected to the swash plate 104 via a piston rod 107. The rotational motion of the rotary journal 103 causes undulating movement of the swash plate 104, which in turn drives the connecting rods and pistons one after another in a linear reciprocating manner.

An elongated hole 109 is formed in a support arm 108 which protrudes from the lug plate 101. The link pin 102 is slidably fitted into the elongated hole 109. Therefore, this fitting design permits the tilting motions of the journal 103 and the swash plate 104. When the piston 106 is at the end of the compression stroke, the top clearance of the piston 106 within the corresponding bore 105 is approximately kept constant. Therefore, the top position of the swash plate 104 does not cause to displace in the front-and-rear direction, regardless of the change of the inclination angle of the swash plate 104. The top clearance is defined as a gap between a valve plate 111 which closes the opening of the bore 105, and the head portion of the piston 106 which is at the end of the compression stroke. Further, the top position of the swash plate 104 is defined as the point where the swash plate 104 is at the closest to the bore 105, according to the undulating movement of the swash plate 104. A sleeve 112 is slidably attached to the drive shaft 100. The rotary journal 103 is pivotally supported by a sleeve pin 113, on the sleeve 112.

In the conventional compressor, when the dimensional accuracy of the elongated hole 109 which guides the pin 102 is low, the top clearance of the piston 106 is difficult to maintain at the approximately constant level, regardless of the change of the tilt angle of the swash plate 104. When the gap between the elongated hole 109 and the pin 102 is rather great, noise is generated therefrom. It is difficult to further improve the dimensional accuracy of the elongated hole 109.

However, the conventional compressor described above is designed such a way that a point of application (Mf) of the compression reaction force which is exerted on the swash plate 104 via the corresponding piston 106 and piston rod 107, and a point of support (Mk) of the compression reaction force via the pin 102 within the elongated hole 109, will be arranged on the line in parallel to the axis of the drive shaft, when the discharge capacity of the compressor is at the maximum, as the inclination angle of the swash plate 104 is at the maximum. Therefore, as the inclination angle of the swash plate decreases, the point of support (Mk) of the compression reaction force via the pin 102 is downwardly moved along the elongated hole 109. Further, the point of application (Mf) arranged on the swash plate 104 which receives the compression reaction force generated by the piston 106 at the top position, is relatively moved upward, with respect to the point of support (Mk).

As a result, the point of application (Mf) of the compression reaction force via the piston 106 at the top position recedes away from the drive shaft 100, further than the point of support (Mk) of the compression reaction force via the pin 102. Therefore, the moment, which causes the inclination angle of the swash plate 104 to further decrease based on the compression reaction force, is generated. The movement of the swash plate 104 toward the decreasing side of the discharge capacity becomes sensitive, based on the influence of this moment. Contrary, the movement of increasing the inclination angle of the swash plate 104 is considerably obstructed by the moment. Therefore, the movement of the swash plate 104 toward the increasing side of the discharge capacity becomes unresponsive. Thus, the overall control for the discharge capacity is not always satisfactory.

SUMMARY OF THE INVENTION

Accordingly, it is a primary objective of the present invention to provide a variable displacement compressor, which can achieve improved control of the discharge capacity, and can reduce its shell diameter, so as to realize overall downsizing.

To achieve the foregoing and other objects in accordance with the purpose of the present invention, an improved variable displacement compressor is provided. The compressor includes a plurality of pistons. Each one of the pistons is accommodated within a corresponding cylinder bore which is formed in a housing, and is reciprocally movable. A drive shaft is rotatably supported by the housing. A lug plate is rotatable with the drive shaft. A swash plate is mounted on the drive shaft, and is tiltable and slidable with respect to the drive shaft. Further, the swash plate is operatively coupled with the pistons. At least one hinge mechanism operatively joins the lug plate with the swash plate. Therefore, the hinge mechanism drives the swash plate to rotate, based on the rotational motion of the drive shaft. The hinge mechanism includes a pin, which has a first and a second end portion. The first end portion is slidably inserted into the swash plate. A support arm protrudes from the lug plate, and further includes a bush. The bush rotatably supports the second end portion of the pin.

BRIEF DESCRIPTION OF THE DRAWINGS

The features of the present invention that are believed to be novel are set forth with particularity in the appended claims. The invention together with the objects and advantages thereof may best be understood by reference to the following description of the presently preferred embodiments taken in conjunction with the accompanying drawings, in which:

DETAILED DESCRIPTION OF THE PREFERRED EMBODIMENTS

Figure 1:
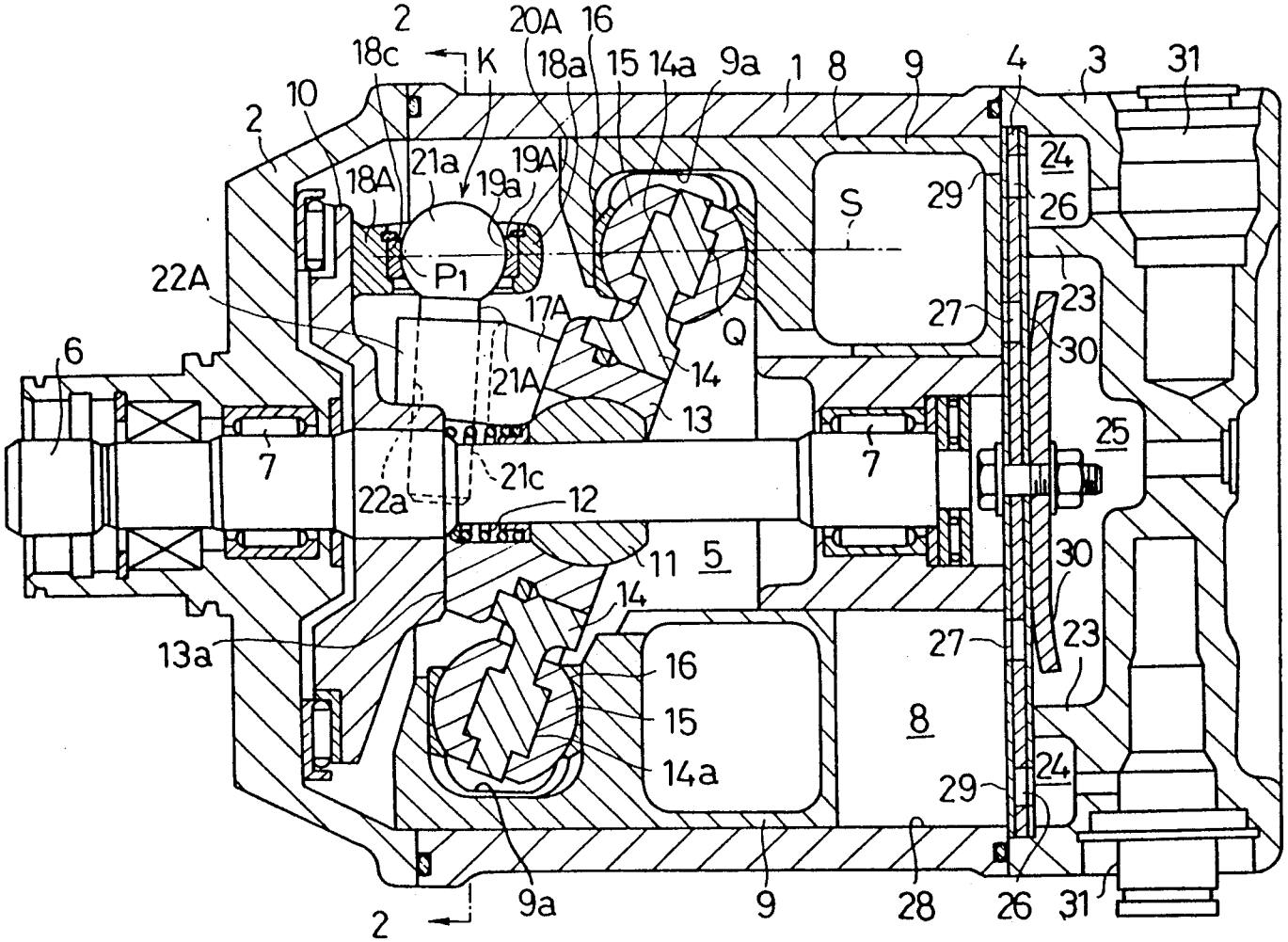
FIG. 1 is a cross-sectional side view illustrating a compressor of this embodiment according to the present invention.

The preferred embodiment of the present invention will now be described, with reference to FIGS. 1 through 5. As shown in FIG. 1, a front housing 2 is connected to a front end portion (left side of FIG. 1) of a cylinder block 1, and a rear housing 3 is connected, via a valve plate 4, to a rear end portion (right side of FIG. 1) thereof. A crank chamber 5 is defined between the cylinder block 1 and the front housing 2. The crank chamber 5 accommodates a drive shaft 6. The drive shaft 6 is rotatably supported by bearings 7. A plurality of cylinder bores 8 are provided around the drive shaft 6 within the cylinder block 1. Each one of the bores 8 accommodates a respective piston 9, which is reciprocally movable therein. A central axis of each piston 9 is extended in parallel, along the axis of the drive shaft 6.

A lug plate 10 synchronously rotatable with the drive shaft 6 is mounted on the drive shaft 6, within the crank chamber 5. A spherical bushing 11 is rotatably and slidably mounted on the drive shaft 6. A spring 12 is disposed between the lug plate 10 and the bushing 11. The spring 12 urges the bushing 11 toward the rear housing 3 (to the rear direction). As shown in FIGS. 1 through 4, a rotary journal 13, which has a generally cylindrical shape for surrounding the bushing 11, is disposed over the bushing 11. The rotary journal 13 is rotatable and tiltable in the back-and-forth direction. The journal 13 has a contact surface 13*a* formed in the front surface thereof. As shown in FIG. 1, the contact surface 13*a* of the journal 13 abuts against the lug plate 10, when the spring 12 is at the most compressed position. Therefore, the rotational movement of the rotary journal 13 is controlled.

The journal 13 is coupled to the lug plate 10, via a pair of hinge mechanisms (K). Therefore, the journal 13 integrally rotates with the drive shaft 6, regardless of the position of the bushing 11 on the drive shaft 6, or the inclination angle of the journal 13.

A swash plate 14 is mounted on the circumference of the journal 13, and is integrally rotatable with the journal 13. A pair of support rails 14*a* each having ring form, with the center on the axis of the drive shaft 6, is formed on both front and rear faces of the swash plate 14. On the other hand, a recess 9*a* having an arc shape in a cross section, is formed at a neck portion of each one of the pistons 9. A pair of inner and outer shoes 15 and 16 is disposed between each recess 9*a* and the support rails 14*a*. The inner shoe 15 is generally pole shape, having a semicircular cross-section. The end surface of the inner shoe 15 having a rectangle shape, is slidably fitted to the corresponding rail 14*a*. The outer shoe 16 slidably contacts with the corresponding recess 9*a*, and also slidably contacts with the corresponding circumference of the inner shoe 15. The axis line of the inner shoe 15 is located on the center of the pair of the support rails 14*a*. The axis line of the recess 9*a* crosses with the axis line of the inner shoe 15. Both shoes 15 and 16 are slidably supported within the corresponding recess 9*a*. Consequently, each one of the pistons 9 is operatively joined to the swash plate 14, via both shoes 15 and 16. Further, the swash plate 14 integrally rotates with the lug plate 10, journal 13 and hinge mechanisms (K), in response to the inclined magnitude of the swash plate 14, when the drive shaft 6 is rotating. Each one of the pistons 9 reciprocates within the corresponding bore 8, via the pair of corresponding shoes 15 and 16, in response to the rotational movement of the swash plate 14.

The rear housing 3 is divided into two parts by a wall 23, to define a suction chamber 24 and a discharge chamber 25. The valve plate 4 has a suction port 26 and a discharge port 27, which correspond to each associated bore 8. A compression chamber 28 is defined between the valve plate 4 and the piston 9. The compression chamber 28 communicates with the suction chamber 24 and the discharge chamber 25, via the suction port 26 and the discharge port 27. Each one of the suction ports 26 and discharge ports 27 has a suction valve 29 and a discharge valve 30. The valve 29 opens or closes the associated suction port 26 and discharge port 27, in response to the reciprocal movement of the pistons 9. A control valve 31 is disposed in the rear housing 3, for regulating the internal pressure of the crank chamber 5.

On the other hand, the hinge mechanism (K) includes a pair of brackets 17A and 17B. Each one of the brackets 17A and 17B is provided around the peripheral portion of the journal 13, which protrudes along the drive shaft 6 and is axially symmetrical with respect to the drive shaft 6. A pair of support arms 18A and 18B are projectingly disposed on the rear surface of the peripheral portion of the lug plate 10, which correspond to the pair of brackets 17A and 17B. The pair of support arms 18A and 18B are symmetrical with respect to the top dead center T of the swash plate 14. The support arms 18A and 18B have holding portions 18*a* and 18*b*, each of which has a generally rectangle shaped cross-section, and which tilt along the arc that has a central point on the axis of the drive shaft 6. The holding portions 18*a* and 18*b* of the arms 18A and 18B include through holes 18*c* and 18*d* each having a circular cross-section and a stepping portion. Bushes 19A and 19B each having a ring shape are inserted into the through holes 18*c* and 18*d*, respectively. Clips 20A and 20B are provided to the corresponding holes 18*c* and 18*d* for preventing the bushes 19A and 19B from detaching. Each one of recesses 19*a* and 19*b* of the bushes 19A and 19B is spherically shaped. Each one of the bushes 19A and 19B is divided into two generally equal parts from the center, with respect to its height direction. Head sections 21*a* and 21*b* of guide pins 21A and 21B are rotatably fitted into the recesses 19*a* and 19*b*, respectively. On the other hand, the brackets 17A and 17B of the journal 13 have guide holes 22*a* and 22*b*, which are formed at the distal portions of the brackets 17A and 17B, respectively. Bar sections 21*c* and 21*d* of the guide pins 21A and 21B are slidably inserted into the corresponding guide holes, respectively.

Figure 2:
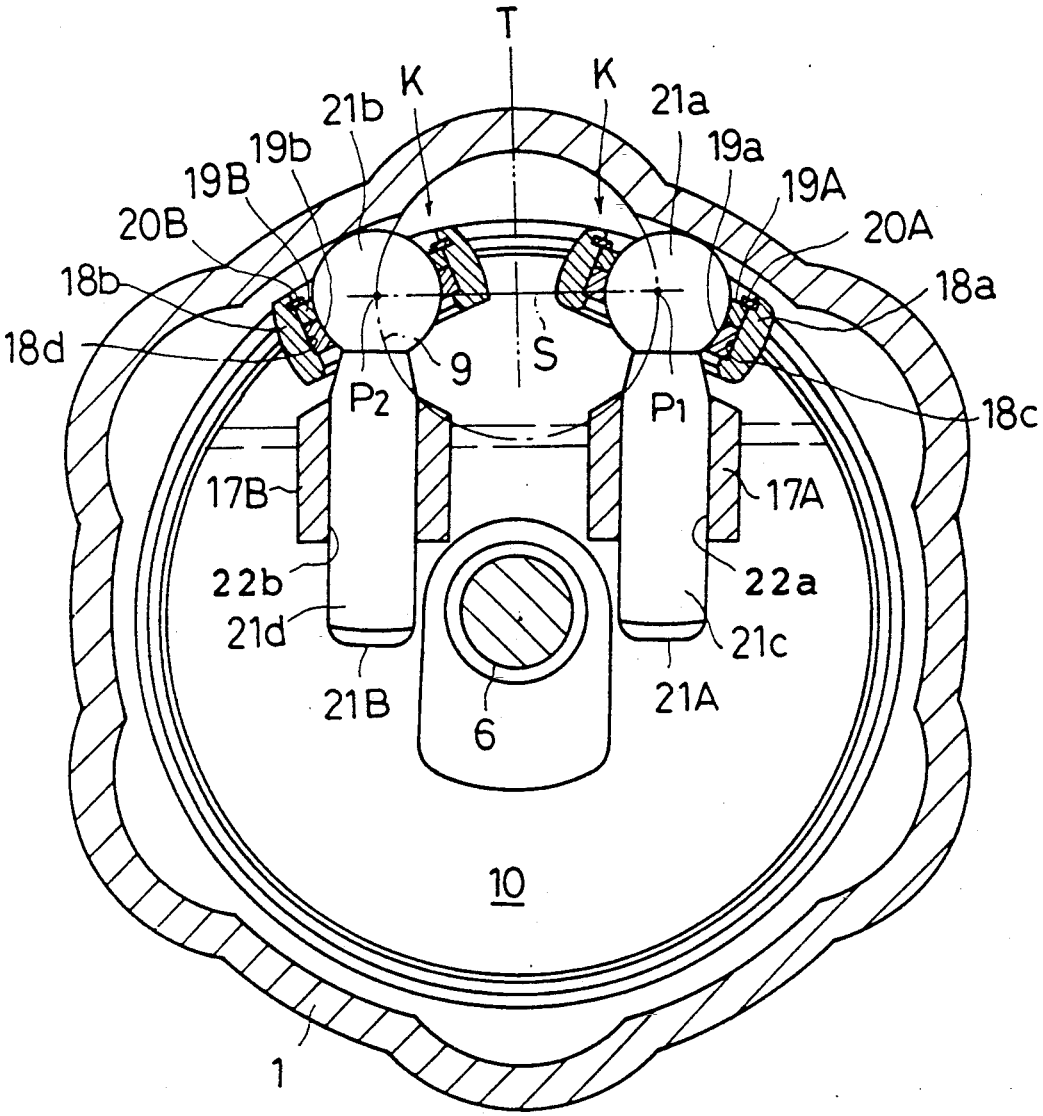
FIG. 2 is a cross-sectional view taken along line 2—2 in FIG. 1.
Figure 3:
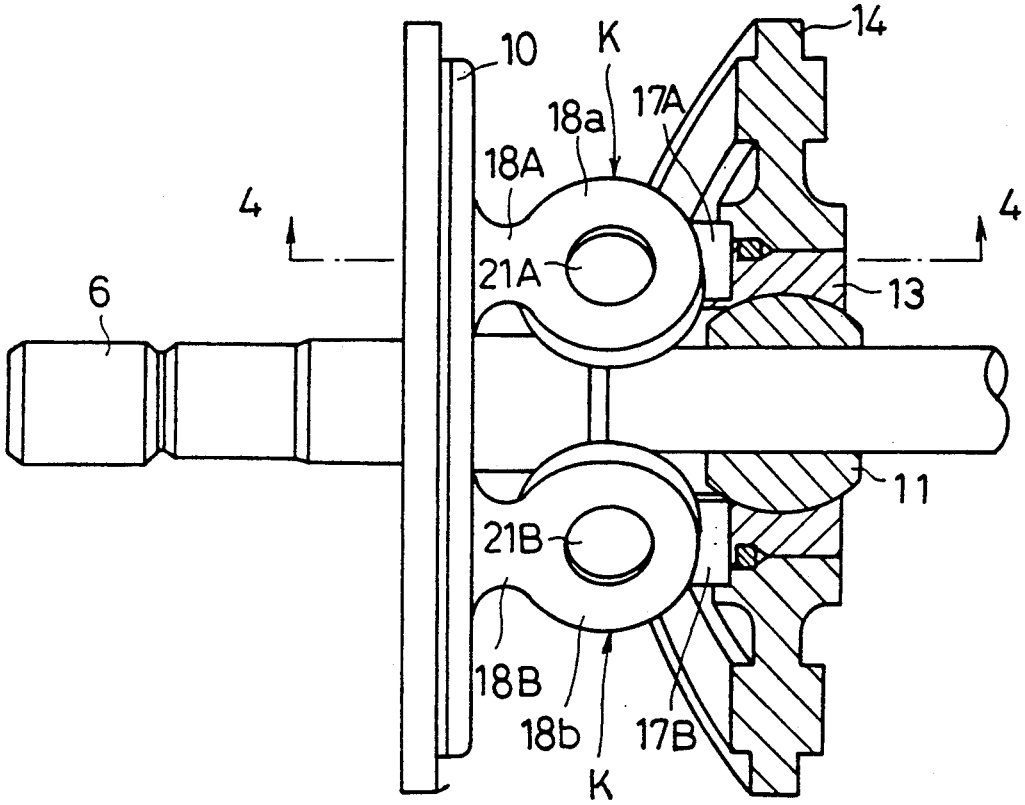
FIG. 3 is an enlarged partial plane view showing the elements around a lug plate for use in the compressor of FIG. 1.
Figure 4:
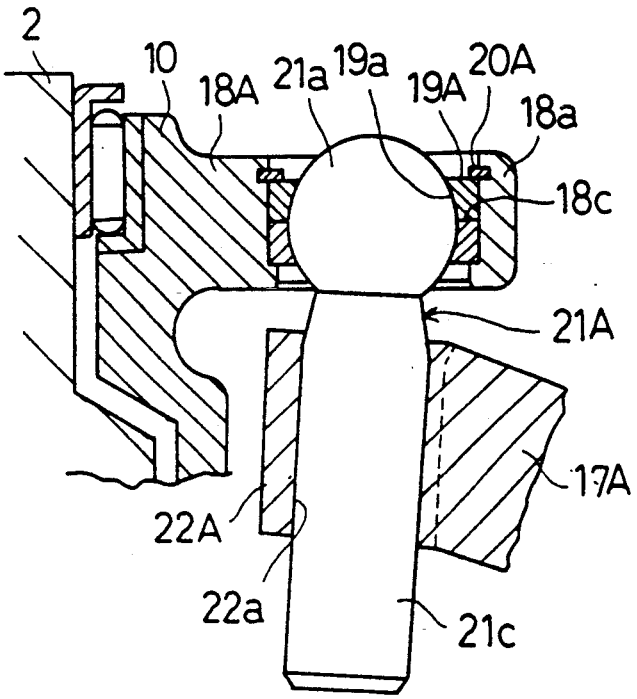
FIG. 4 is a cross-sectional view taken along line 4—4 in FIG. 3.
Figure 5:
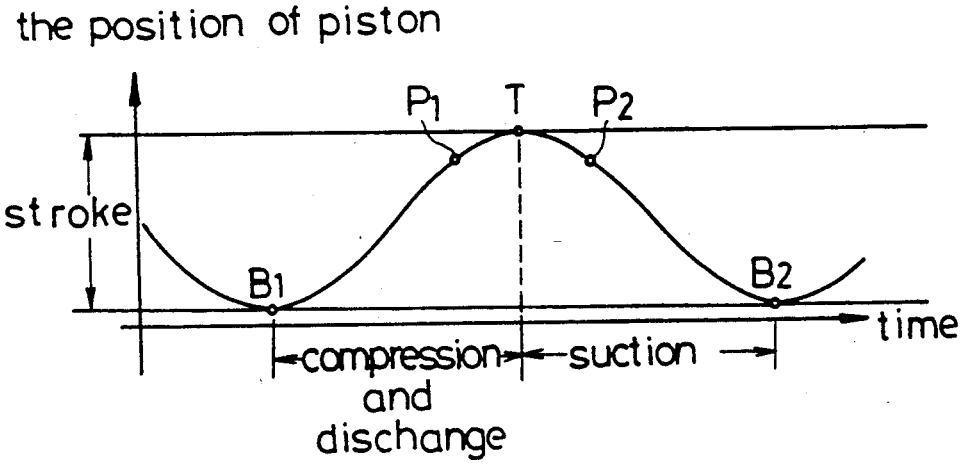
FIG. 5 is a characteristic diagram showing the correlation between the position of the piston, and time of the compressor of FIG. 1.

As shown in FIGS. 1 and 2, in each hinge mechanism (K), first and second points of support (P1) and (P2), which receive the compression reaction force, generated during a compression stroke of the piston, are located between the head sections 21*a* and 21*b* of the guide pins 21A and 21B, and the recesses 19*a* and 19*b* of the bushes 19A and 19B. A point of application (Q) of the compression reaction force acting against the swash plate 14 via the piston 9 corresponding to the top position of the swash plate 14, and the points (P1) and (P2) are located on a hypothetical plane (S), including the central axis line of the above specific piston 9. In other words, a middle point of a line connecting between the first point of support (P1) corresponding to the guide pin 21A and the second point of support (P2) corresponding to the guide pin 21B is designed to always befall on axis line of the piston 9, which is at the top dead point of the compression stroke. Therefore, as shown in FIG. 5, when the first point of support (P1) corresponds to the axis line of an arbitrary piston 9, the piston 9 is at the middle of the compression stroke. When the second point of support (P2) corresponds to the axis line of an arbitrary piston 9, the piston 9 is at the middle of the suction stroke.

In the compressor having the above-described configuration, when the swash plate 14 rotates synchronously with the drive shaft 6, each one of the pistons 9 reciprocates within the corresponding bore 8, via the corresponding pair of the outer shoes 16 and inner shoes 15. This reciprocating motion causes refrigerant gas to be introduced to the bores 8 from the suction chamber 24. After the gas is compressed in the bores 8, the gas is discharged into the discharge chamber 25. The capacity of the compressed gas is controlled, in such a way that the control valve 31 regulates the internal pressure within the crank chamber 5.

For example, when the internal pressure within the crank chamber 5 decreases in response to the pressure control adjustment by the control valve 31, the inclination angle of the swash plate 14 increases, in accordance with the pressure exerted on the tail end face of each piston 9 decreasing. When the inclination angle of the swash plate 14 is increased, the head sections 21*a* and 21*b* of the guide pins 21A and 21B in the hinge mechanisms (K) slide within the recesses 19*a* and 19*b* of the bushes 19A and 19B, respectively. The bar sections 21*c* and 21*d* of the guide pins 21A and 21B are rearwardly rotated (toward the rear housing 3, to the right side of FIG. 1), around the head sections 21*a* and 21*b*, respectively. The brackets 17A and 17B of the rotary journal 13 are rotated rearwardly (toward the rear housing 3), via the connections of the bar sections 21*c* and 21*d* with the brackets 17A and 17B, around the spherical bushing 11. Further, the bushing 11 is forwardly moved toward the front housing 2, against the urging force of the spring 12. Furthermore, the guide pins 21A and 21B are slid into the guide holes 22*a* and 22*b*, respectively. As a result, the inclination angle of the swash plate 14 increases.

The outer shoe 16 slides toward the drive shaft 6 within the recess 9*a* of the corresponding piston 9, while that shoe 16 is sliding along the peripheral surface of the corresponding inner shoe 15. Therefore, as the stroke of the piston 9 is extended, the compression capacity increases. When the inclination angle of the swash plate 14 reaches the maximum value, the compressor operates at the maximum capacity.

On the contrary, when the internal pressure within the crank chamber 5 increases, due to the blow-by-gas as the communication between the crank chamber 5 and the suction chamber 24 is shut off by the control valve 31, the pressure exerted on the tail end face of each piston 9 increases. As a result, the inclination angle of the swash plate 14 decreases. When the inclination angle of the swash plate 14 decreases, the bar sections 21*c* and 21*d* of the guide pins 21A and 21B are frontwardly rotated (toward the front housing 2, to the left side of FIG. 1), around the head sections 21*a* and 21*b* of the guide pins 21A and 21B, respectively. The brackets 17A and 17B of the rotary journal 13 are frontwardly rotated (toward the front housing 2), via the connections of the bar sections 21*c* and 21*d* with the brackets 17A and 17B. Further, the spherical bushing 11 is rearwardly moved toward the rear housing 3, in response to the urging force of the spring 12. Furthermore, the guide pins 21A and 21B are slid in the extracted direction from the guide holes 22*a* and 22*b*, respectively. As a result, the inclination angle of the swash plate 14 is decreased.

The outer shoe 16 slides toward the cylinder block 1, within the recess 9*a* of the corresponding piston 9, while that shoe 16 is sliding along the peripheral surface of the corresponding inner shoe 15. Therefore, the stroke of the piston 9 is shortened, and the compression capacity decreases. When the inclination angle of the swash plate 14 reaches the minimum value, the compressor operates at the minimum capacity.

When the above-described compressor is operating, the hinge mechanism (K) accepts the compression reaction force generated by the piston during the compression stroke, and transmitted to the swash plate 14 via the shoes 15 and 16, at the first point of support (P1). Further, the hinge mechanism (K) supports the force transmitted to the swash plate 14 from the piston during the suction stroke, at the second point of support (P2). As each one of the first and second points of support (P1) and (P2) never shifts along the rotational direction of the swash plate 14, the hinge mechanism (K) thus supports the resultant force of the compression reaction force and the suction force. Therefore, the displacement of the swash plate 14 does not generate the bending moment. The spherical bushing 11 does not receive the unbalanced load. Therefore, the rotary journal 13 contacting the peripheral surface of the bushing 11 can be smoothly rotated.

This improved compressor no longer requires that a cylindrical bushing pin supports the rotary journal, and the bushing pin thus receives the bending moment generated on the swash plate, unlike the conventional compressor. Therefore, uneven wear of the rotary journal can be prevented, and the drawbacks of noise and durability can be solved.

In this compressor, both guide pins 21A and 21B slide along the guide holes 22*a* and 22*b*, while the guide pins 21A and 21B rotate with respect to the lug plate 10, in response to the change of the inclination angle of the swash plate 14, based on the pressure difference between the inner pressure of the crank chamber 5 and the suction pressure. Therefore, the rotary journal 13 inclines, while the bushing 11 slides on the drive shaft 6, in such a way that the top position of the swash plate 14 is kept fixed, with respect to the longitudinal direction of the drive shaft 6. The top clearance of the piston 9 is kept approximately constant, regardless of the inclination angle of the swash plate 14.

Even when the inclination angle of the swash plate 14 is changed, each of the first and second points of support (P1) and (P2) of the compression reaction force does not change its position, with respect to the radial direction of the cylinder block 1. Therefore, the rotational moment against the swash plate 14 is not generated, based on the compression reaction force via the piston 9 at the top position. Increase or decrease of the inclination angle of the swash plate 14 can be smoothly performed. Therefore, the control ability of the discharge capacity is increased.

Centrifugal force is exerted on each one of the guide pins 21A and 21B, generated by the rotation of the drive shaft 6. The centrifugal force is received by the support arms 18A and 18B, via the bushes 19A and 19B. Therefore, the swash plate 14 does not incline in a certain direction, by way of the centrifugal force. Consequently, even when the rotational speed of the drive shaft 6 is increased to generate greater centrifugal force which is exerted on each one of the guide pins 21A and 21B, the control ability for discharge capacity is not effected. Specifically, when this compressor is used in an automotive air conditioner, it is required that as the rotational speed of the drive shaft 6 increases, the discharge capacity decreases, in response to the decrease of the inclination angle of the swash plate. However, the above mentioned characteristic is preferable for the automotive air conditioner.

In the guide pins 21A and 21B, the head sections 21*a* and 21*b* located at the outer peripheral side of the cylinder block, are rotatably held by means of the support arms 18A and 18B, respectively. The bar sections 21*c* and 21*d* located as close as possible to the drive shaft 6, are slidable in the guide holes 22*a* and 22*b*. Therefore, the load balance of the objects, which integrally rotate with the drive shaft 6, does not significantly change, in response to the reciprocal slide motion of the guide pins 21A and 21B. Therefore, vibration and the like based on the change of the load balance is not generated, such that the rotational motion of the rotary journal 13 and the swash plate 14 becomes stable.

As described above, in the compressor according to this embodiment, the guide pins 21A and 21B are rotatably supported by the support arms 18A and 18B, and do not detach from the arms 18A and 18B, respectively. The arms 18A and 18B are formed to incline along the arc with its center on the axis of the drive shaft 6. Therefore, the arms 18A and 18B can be disposed much closer to the inner peripheral surface of the cylinder block 1. As a result, the shell diameter of the compressor can be further downsized.

In this case, the distance between the pair of the hinge mechanisms (K) can be designed to have a larger separation. The widening the distance therebetween causes the distance between the both points of support (P1) and (P2) to widen. Therefore, the rotational motion of the swash plate 14 becomes more stable and smoother.

Another embodiment according to the present invention will now be described, referring to drawings. In this embodiment, the support design of the guide pins differs from that of the above-described embodiment.

Figure 6:
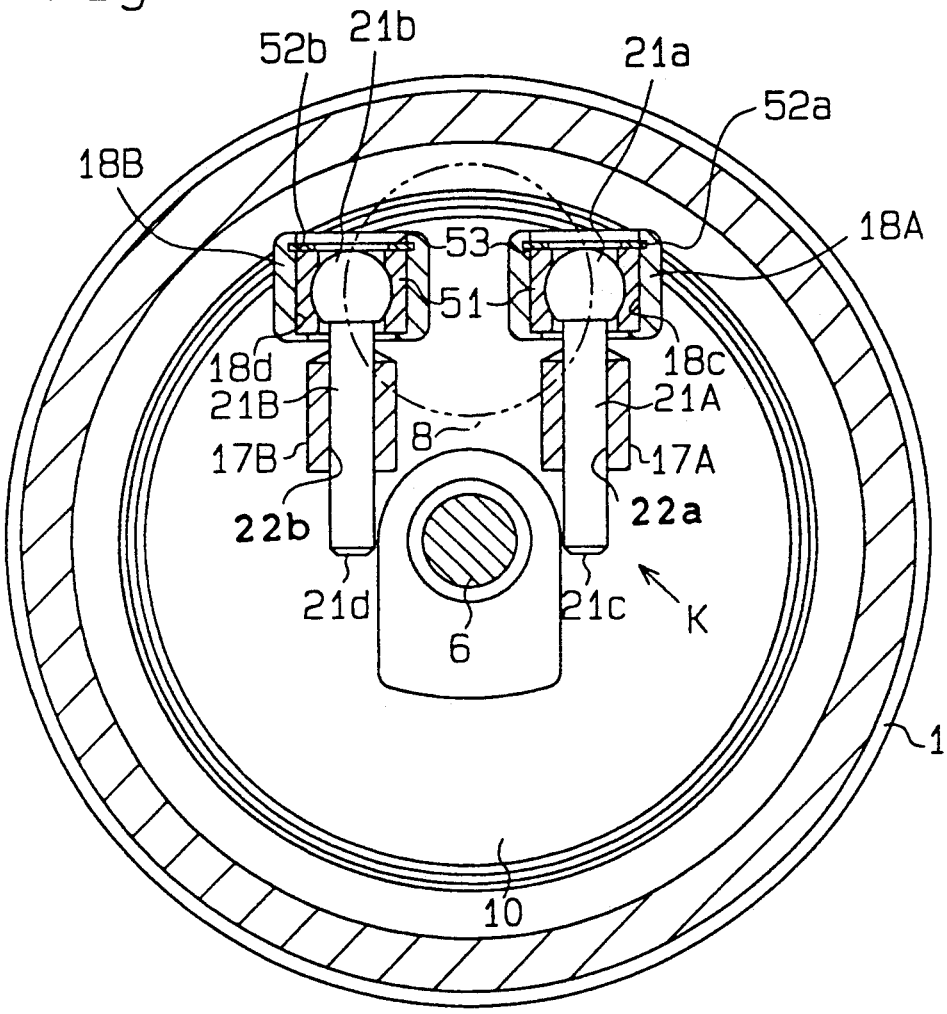
FIG. 6 is a cross-sectional view corresponding to FIG. 2, according to another embodiment of the present invention.
Figure 7:
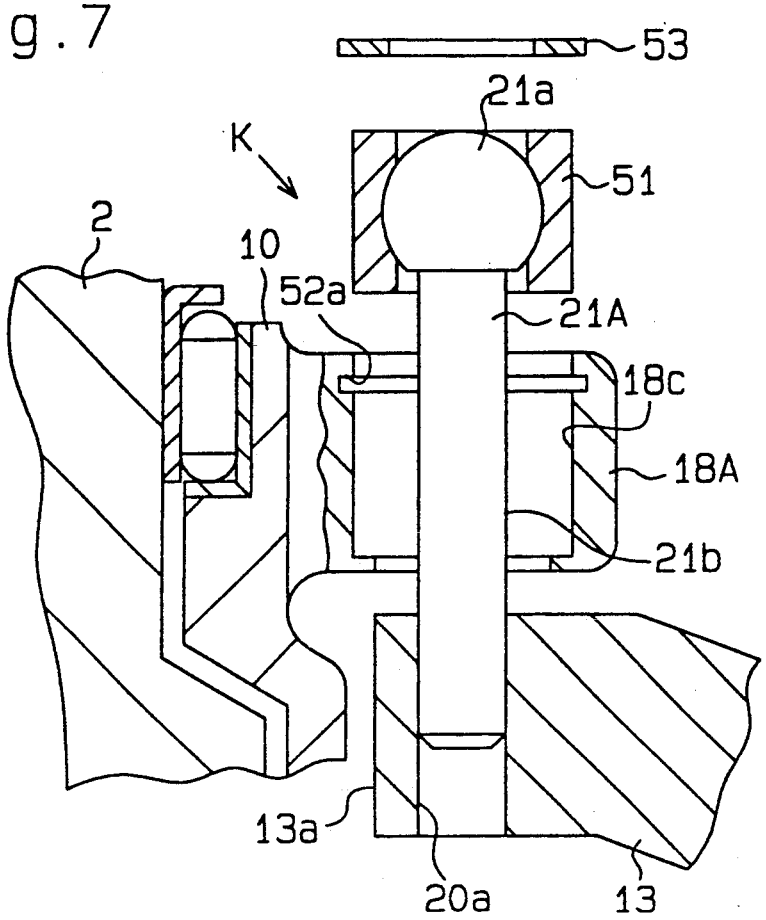
FIG. 7 is a partial exploded cross-section side view illustrating the hinge mechanism of the compressor in FIG. 2.
Figure 8:
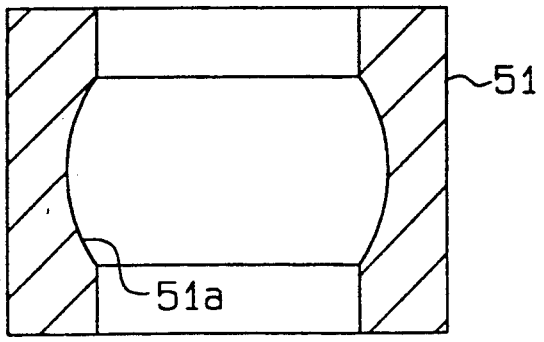
FIG. 8 is an enlarged cross-sectional view illustrating a bush of the hinge mechanism in FIG. 7.
Figure 9:
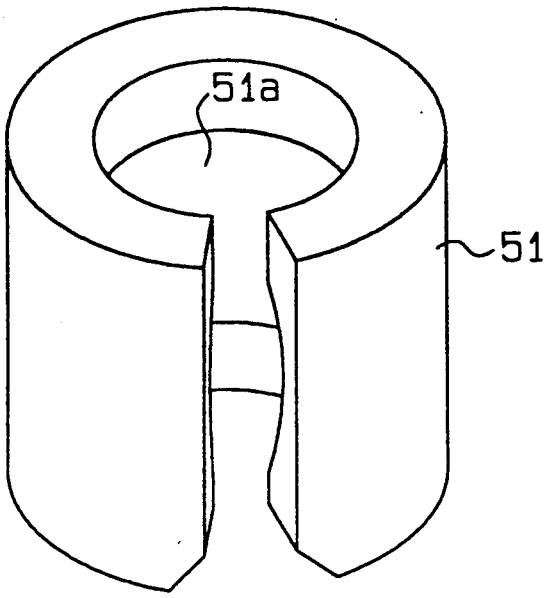
FIG. 9 is a perspective view illustrating the bush of the hinge mechanism in FIG. 7.

In this embodiment, as shown in FIG. 6, the pair of the support arms 18A and 18B of the hinge mechanisms (K) is located in a flat surface, which is parallel to the plane including the axis of the drive shaft 6. The through holes 18*c* and 18*d* each including a step portion, of the arms 18A and 18B, accommodate bushes 51, respectively. As shown in FIGS. 8 and 9, the bush 51 is of cylindrical shape having a generally C-shaped cross-section, and a recess 51*a* having a generally spherical shape formed around the inner peripheral surface thereof. Each one of the head sections 21*a* and 21*b* of the guide pins 21A and 21B is slidably fitted into the corresponding recess 51*a* of the bush 51.

Grooves 52*a* and 52*b* each having a larger diameter than that of each through hole 18*c* and 18*d*, are formed in the vicinity of the corresponding openings of the through holes 18*c* and 18*d* of the arms 18A and 18B, respectively. A generally ring shape clip 53 is fitted into each one of the grooves 52*a* and 52*b*. These clips 53 prevent the bush 51 from detaching from the corresponding arm.

The sequence for connecting the rotary journal 13 to the lug plate 10, via the hinge mechanisms (K) will now be described. The lug plate 10, the spring 12, the spherical bushing 11 and the rotary journal 13 are inserted over the drive shaft 6, in named order. On the other hand, the inner diameter of the recess 51*a* is enlarged by broadening the bush 51. Each of the head sections 21*a* and 21*b* of the guide pins 21A and 21B is engaged with the corresponding enlarged recess 51*a*. After that, each one of the bar sections 21*c* and 21*d* of the guide pins 21A and 21B is inserted into the through holes 18*c* and 18*d* of the arms 18A and 18B of the lug plate 10, and guide holes 22*a* and 22*b* of the brackets 17A and 17B of the rotary journal 13, respectively in sequentially named order. Then, the lug plate 10 and the journal 13 are temporarily connected.

The bushes 51 are engaged with the through holes 18*c* and 18*d* of the arms 18A and 18B, respectively. Further, under this condition, the clips 53 are fitted into the grooves 52*a* and 52*b*, respectively. Therefore, the lug plate 10 and the rotary journal 13 are securely connected via the hinge mechanisms (K), with more accuracy. Therefore, the noise generation from the connecting portion is significantly reduced.

In order to disconnect the lug plate 10 from the rotary journal 13, when the guide pins 21A and 21B are to be removed, each clip 53 is removed from each one of the grooves 52*a* and 52*b*, then the guide pins 21A and 21B and the bushes 51 are removed from the support arms 18A and 18B and brackets 17A and 17B. By this manipulation, the lug plate 10 and the rotary journal 13 are easily disconnected.

Figure 10:
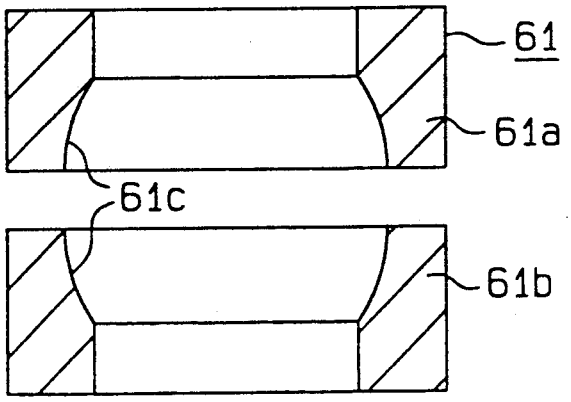
FIG. 10 is a cross-sectional view illustrating the bush of the hinge mechanism, according to another embodiment.
Figure 11:
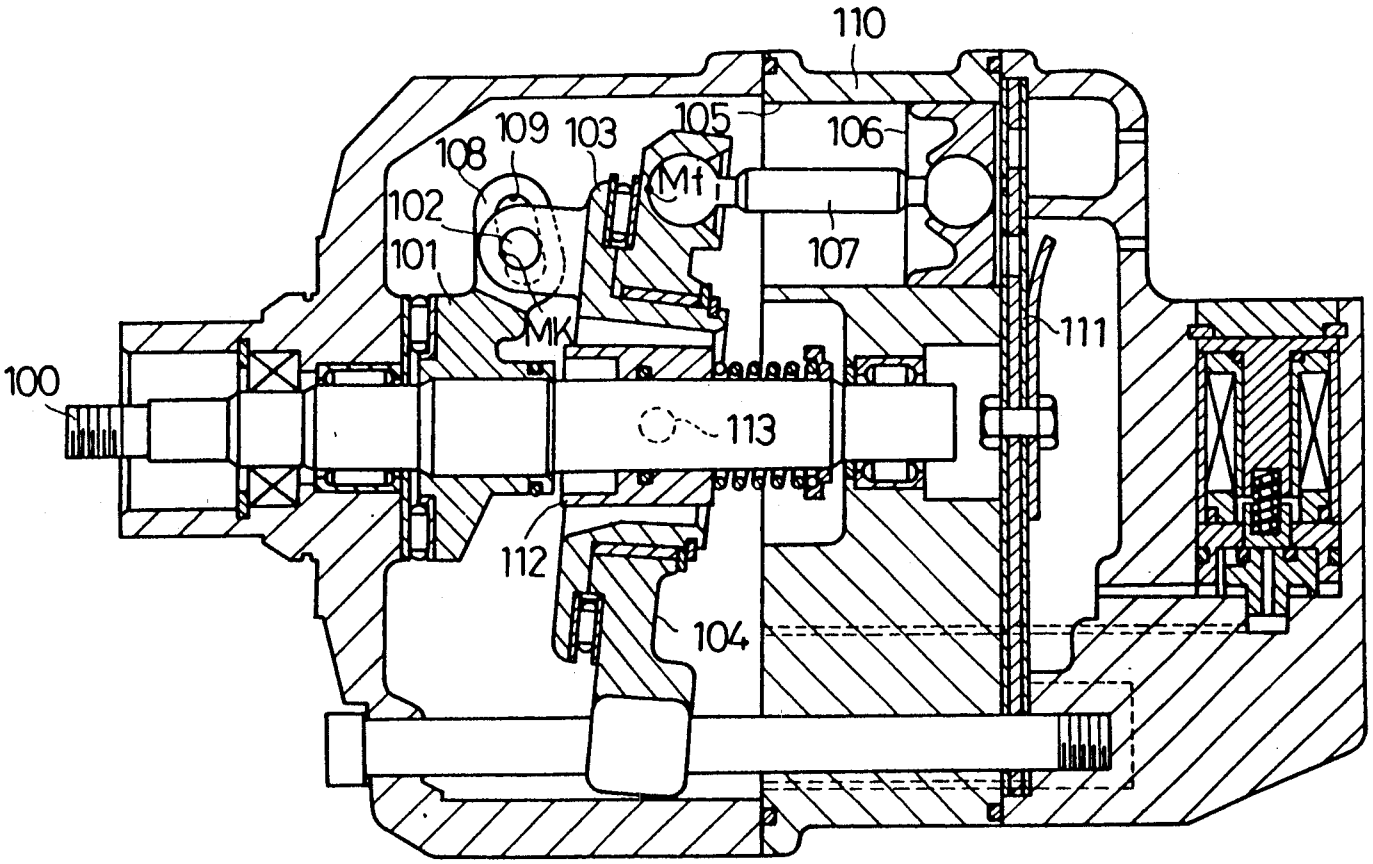
Fig. 11 (PRIOR ART)
FIG. 11 is a cross-sectional view of a conventional compressor, corresponding to FIG. 1.

The present invention is not limited to the above-described embodiments, but the structure may be modified without departing from the scope of the invention, as follows:

(1) As shown in FIG. 10, a bush 61 is formed in a cylindrical shape. A recess 61*c* having a spherical shape is formed inside of the bush 61. The bush 61 is divided into two generally equal portions from the middle section, with respect to its vertical direction; an upper divided portion 61*a* and a lower divided portion 61*b*. In this case, when the bush is put together, the bush is no longer required to be expanded. Therefore, assembling the guide pins 21A and 21B with the bushes becomes much simpler. The embodiment described in FIG. 2 is similar to this embodiment, in relation to this point.

Furthermore, the bush can be vertically divided into two portions, along the axis of the bush. In this case, assembling the guide pins 21A and 21B with the bushes also becomes much simpler.

(2) The swash plate 14 can be connected with each one of the pistons 9, via a corresponding connecting rod, in place of the connecting mechanism of the swash plate and the pistons employing both inner and outer shoes 15 and 16, described in the preferred embodiments.

(3) In the preferred embodiments described in FIGS. 1–10, the compressor employs the swash plate 14 which synchronously rotates with the drive shaft 6. The present invention can be embodied in the some type of compressors, of which the swash plate relatively slides with respect to the rotary journal, and does not rotate by itself, similar to that of the conventional compressor.

What is claimed is:

1. A variable displacement compressor, comprising:

a) a housing having a plurality of cylinder bores disposed therein;

b) a plurality of pistons reciprocatively disposed in said cylinder bores;

c) a drive shaft rotatively supported in said housing along an axis thereof;

d) a lug plate having a support arm disposed along an arc centered on said axis of said drive shaft, said lug plate being in rotative communication with said drive shaft;

e) a swash plate member slidably and tiltably mounted on said drive shaft and operatively connected with said pistons, said swash plate member including a swash plate and a rotary journal having at least one bracket; and f) a hinge mechanism for rotatively coupling said lug plate with said swash plate member, said hinge mechanism including a pin having first and second end portions, said first end portion being connected to the rotary journal bracket and said second end portion being connected to said support arm of the lug plate.

2. The compressor according to claim 1, wherein said hinge mechanism is provided by first and second pins, brackets and support arms respectively, all disposed symmetrically with respect to said drive shaft.

3. The compressor according to claim 1, wherein said first end portion of said pin has a bar shape, and said second end portion thereof has a spherical shape for rotational engagement with said support arm.

4. The compressor according to claim 3 wherein said support arm includes a bush disposed therein for sliding spherical engagement with said spherical shaped second end portion of said pin.

5. The compressor according to claim 4, wherein the point of support of the compression reaction force is disposed between said second end portion of said pin and said bush when each piston is on the compression stroke and the compression reaction force is transferred to the swash plate and the hinge mechanism.

6. The compressor according to claim 5, wherein the points of application of the compression reaction forces on said swash plate and said hinge mechanism when each said piston is at the top dead center position of the compression stroke are designed to lay on a hypothetical plane that includes the central longitudinal axis of said piston.

7. The compressor according to claim 3 wherein said first end portion of said pin is slidably inserted into the rotary journal bracket.

8. The compressor according to claim 4, wherein said bush is generally cylindrically shaped, said bush includes a spherical recess disposed therein, and a groove disposed in the circumferential wall thereof for communicating with a complementary groove disposed in said support arm.

9. The compressor according to claim 4, wherein said bush is generally cylindrically shaped, said bush includes a spherical recess disposed therein, and said bush is divided into generally two equal portions at the center with respect to its height.

10. The compressor according to claim 8, wherein said bush is secured to said support arm by means of a clip disposed within said grooves.

11. A variable displacement compressor, comprising:

a) a housing including a closed crankcase and having a plurality of cylinder bores disposed therein;

b) a plurality of pistons reciprocatively disposed in said cylinder bores;

c) a drive shaft rotatively supported in said housing along an axis thereof;

d) a lug plate in rotative communication with said drive shaft and having at least one support arm disposed thereon;

e) a swash plate member operatively connected with said pistons; said swash plate member including a spherical bushing mounted for sliding engagement on said drive shaft, a rotary journal, with at least one bracket disposed thereon, mounted for tilting engagement on said spherical bushing, and a swash plate disposed in rigid mechanical communication with said rotary journal;

f) an inclination means for changing the inclination angle of the swash plate with respect to said drive shaft axis, said inclination means including biasing means disposed between the spherical bushing and the lug plate, and control means for changing the pressure within said crankcase, said inclination means responding to change in crankcase pressure for causing said swash plate member to change its angle of inclination with respect to said drive shaft axis by rotating about said spherical bushing and causing said spherical bushing to adjust its axial position against said biasing means such that the top dead center clearance between said cylinder bores and said pistons remains constant; and g) a support means for supporting said swash plate member in a manner that does not interfere with said inclination means to provide support for said swash plate member as it moves through a selected range of inclination angles without creating any rotational moment forces due to the reaction forces of the pistons, said support means including a hinge mechanism for rotatively coupling said rotary journal with said lug plate, said hinge mechanism including a pin having first and second end portions, said first end portion being connected to the rotary journal bracket and said second end portion being connected to said support arm of the lug plate.

12. The variable displacement compressor according to claim 11, wherein said first end portion of said pin has a bar shape, and said second end portion thereof has a spherical shape for rotational engagement with said support arm.

13. The variable displacement compressor according to claim 12, wherein said support arm includes a bush disposed therein for sliding spherical engagement with said spherical shaped second end portion of said pin.

14. The compressor according to claim 13, wherein said bush is generally cylindrically shaped, said bush includes a spherical recess disposed therein, and a groove is disposed in the circumferential wall thereof for communicating with a complementary groove disposed in said support arm.

15. The compressor according to claim 14, wherein said bush is secured to said support arm by means of a clip disposed within said grooves.

16. The compressor according to claim 12, wherein the point of support of the compression reaction force is disposed between said second end portion of said pin and said bush when each piston is on the compression stroke and the compression reaction force is transferred to the swash plate and the hinge mechanism.

17. The compressor according to claim 16, wherein the point of application of the compression reaction force on said swash plate and said hinge mechanism when each said piston is at the top dead center position of the compression stroke are designed to lay on a hypothetical plane that includes the central longitudinal axis of said piston.

18. The compressor according to claim 12 wherein said first end portion of said pin is slidably inserted into the rotary journal bracket.

19. The compressor according to claim 13, wherein said bush is generally cylindrically shaped, said bush includes a spherical recess disposed therein, and said bush is divided into generally two equal portions at the center with respect to its height.

* * * * *